United States Patent [19]

House

[11] 4,439,956

[45] Apr. 3, 1984

[54] PRESS LOCK FASCIA-CANT SYSTEM

[75] Inventor: David C. House, Omaha, Nebr.

[73] Assignee: Prawl Engineering Corporation, Omaha, Nebr.

[21] Appl. No.: 404,411

[22] Filed: Aug. 2, 1982

[51] Int. Cl.[3] ..... E04D 3/38; E04B 7/00

[52] U.S. Cl. ..... 52/60; 52/94

[58] Field of Search ..... 52/58, 408, 94, 95, 52/459, 60, 57, 59, 61, 62, 769, 401, 63; 248/489, 316.1; 160/327, 350, 402, 404; 24/243 K, 259 FH

[56] References Cited

U.S. PATENT DOCUMENTS

| | | | |
|---|---|---|---|
| 1,336,903 | 4/1920 | Hoofnagle | 248/316.1 |
| 2,005,454 | 6/1935 | Clark | 24/243 K |
| 3,571,992 | 3/1971 | Comiskey | 52/60 |
| 3,585,766 | 6/1971 | Jamieson | 52/60 |
| 3,680,269 | 8/1972 | Fischer et al. | 52/94 |
| 3,738,068 | 6/1973 | Attaway | 52/60 |
| 3,763,605 | 10/1973 | Freeman | 52/58 |
| 3,766,694 | 10/1973 | Minialoff | 52/95 |
| 3,862,531 | 6/1976 | Attaway et al. | 52/58 |
| 3,928,897 | 12/1975 | Tomby | 160/327 |
| 4,067,152 | 1/1978 | Wolma | 52/58 |
| 4,071,987 | 2/1978 | Hickman | 52/94 |
| 4,231,141 | 11/1980 | Derreck et al. | 160/380 |
| 4,241,549 | 12/1980 | Hall et al. | 52/60 |

*Primary Examiner*—John E. Murtagh
*Assistant Examiner*—Andrew Joseph Rudy
*Attorney, Agent, or Firm*—Zarley, McKee, Thomte, Voorhees & Sease

[57] ABSTRACT

A press lock fascia-cant system for installing on a building roof to secure the roof membrane in a watertight fashion. A cant member is secured to the roof adjacent the building wall and has a spring clip member secured thereto. The edge of the roof membrane extends upwardly over the cant and over the spring clip member and then downwardly along the outer surface of the spring clip member. A fascia member is detachably secured to the spring clip member and presses the roof member into engagement with the cant member and the spring clip member to maintain the roof member therebetween.

1 Claim, 3 Drawing Figures

PRESS LOCK FASCIA-CANT SYSTEM

BACKGROUND OF THE INVENTION

This invention relates to a fascia cant system and more particularly to a press lock fascia-cant system for use on a building roof adjacent a wall to secure the roof membrane thereto.

Many types of fascia and flashing systems have been provided in an effort to secure the edge of a roofing sheet or membrane to the roof or the upper end of the wall adjacent the roof. For example, U.S. Pat. No. 4,241,546 discloses a conjoint fascia, flashing and water dam. Although it is believed that the system described in U.S. Pat. No. 4,241,549 may be generally acceptable, it is believed that the present invention represents a distinct improvement over that of said patent since the present invention provides a more positive engagement of the roof membrane between the components of the invention.

Therefore, it is a principal object of the invention to provide an improved press lock fascia-cant system for installation on a building roof adjacent a wall.

A further object of the invention is to provide a press lock fascia-cant system which positively maintains the edge of the roof membrane therein to prevent the roof membrane from being torn therefrom.

Still another object of the invention is to provide a press lock fascia-cant system which provides a watertight seal for the termination of the roof membrane.

Another object of the invention is to eliminate penetrations through the roof membrane by the flashing system.

Another object of the invention is to provide a press lock fascia-cant system which results in reduced labor being required in the installation phase.

These and other objects will be apparent to those skilled in the art.

SUMMARY OF THE INVENTION

A press lock fascia-cant system is described which is mounted on a building roof adjacent the upper end of a wall. The fascia-cant system of this invention is designed to not only provide a watertight seal at the edge of the roof membrane but to positively maintain the roof membrane therein so that the membrane will not be torn therefrom. A cant member is secured to the roof adjacent the wall and has a spring clip member mounted thereon. The edge of the roof membrane extends upwardly over the cant and the spring clip member and thence downwardly along the outer side of the spring clip member. A fascia member is locked onto the spring clip member and presses the roof membrane into engagement with the cant member and presses the roof membrane between it and the spring clip member.

DESCRIPTION OF THE PREFERRED EMBODIMENT

Figure 1:
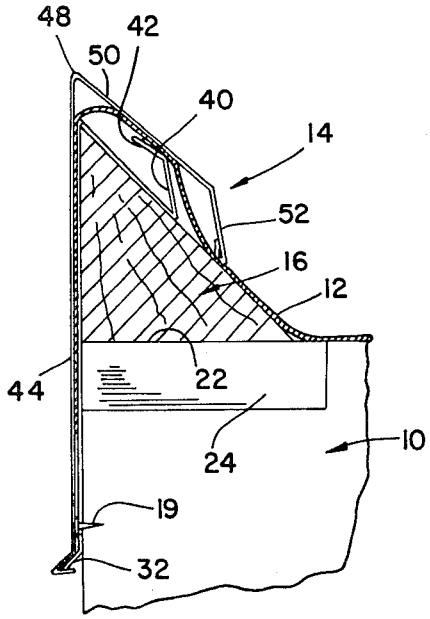
FIG. 1 is a sectional view illustrating the press lock fascia-cant system of this invention.
Figure 2:
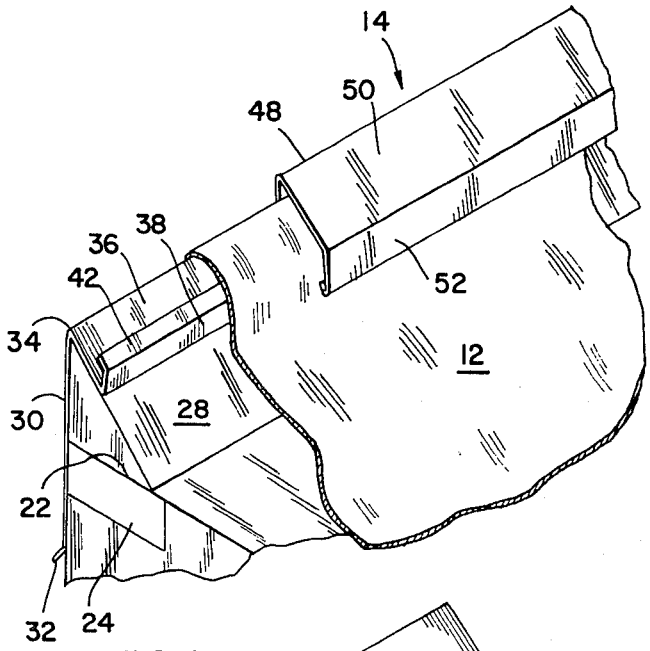
FIG. 2 is a perspective view illustrating the system of this invention.
Figure 3:
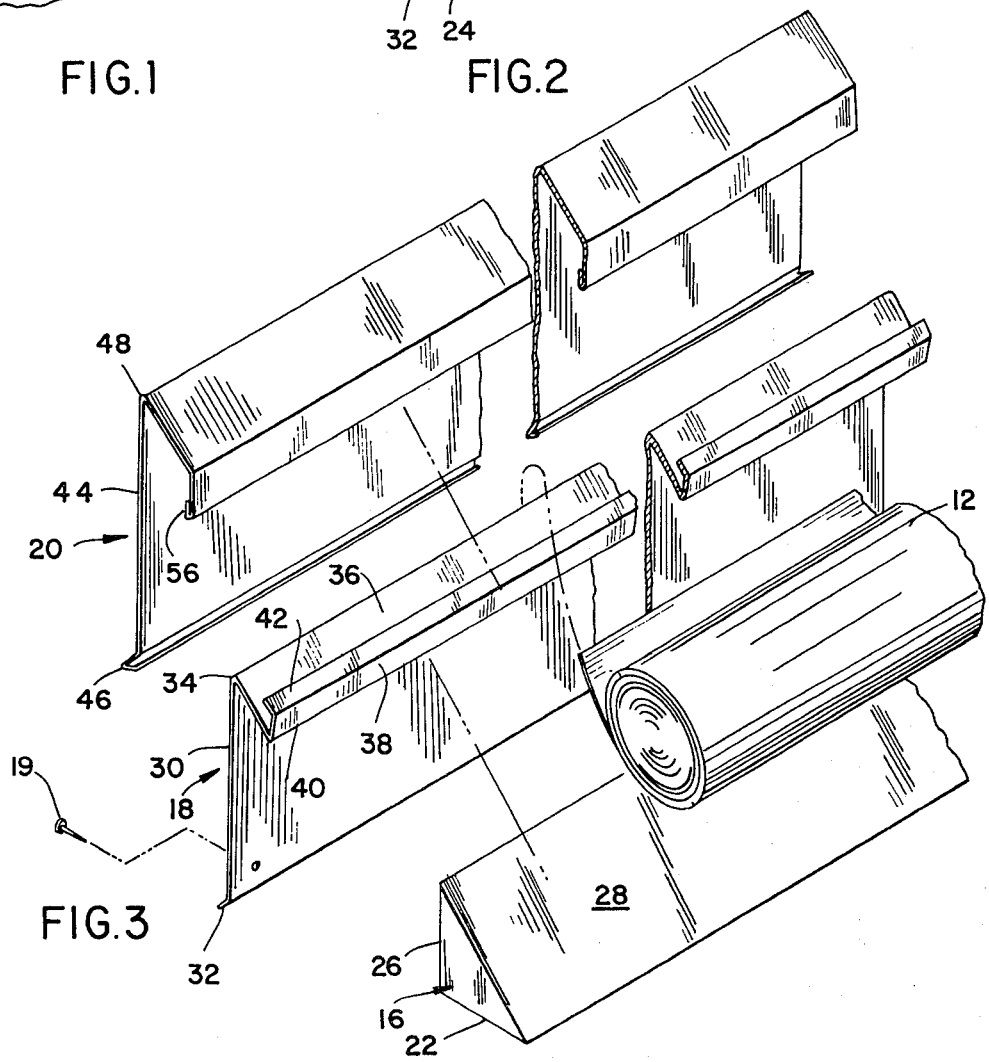
FIG. 3 is an exploded perspective view of the invention.

In FIG. 1, the numeral 10 refers to a building roof 10 while the numeral 12 refers to a roof membrane such as a EPDM(single/ply) member of conventional construction. The numeral 14 refers to the press lock fascia-cant system of this invention which is designed to provide a means for securing the edge of the roof membrane 12 to the roof so that a watertight and secure connection is provided. System 14 generally comprises cant member 16, spring clip member 18, and fascia member 20.

Cant member 16 may be comprised of metal or wood and is in the form of a right triangle being a flat bottom portion 22 secured to a wooden member 24 which is ordinarily a 2×6 member. Member 24 is secured to the roof 10 in conventional fashion. Cant member 16 includes an outer wall portion 26 and an inclined wall portion 28 as illustrated in the drawings.

Spring clip member 18 is secured to cant member 16 by nails or the like and comprises an outer wall member 30 having a lower end portion 32 which extends downwardly and outwardly away from the building and the cant member 16 as ilustrated. The upper end 34 of spring clip member 18 is positioned at the upper end of wall 26 of cant member 16. Spring clip member 18 includes an inclined wall portion 36 which extends downwardly and inwardly from the upper end of outer wall member 30 along the upper surface of wall portion 28 of cant member 16. A spring portion 38 extends upwardly from the lower end of inclined wall portion 36 and comprises wall members 40 and 42. As seen in the drawings, wall portion 40 extends generally upwardly from the lower end of wall portion 36 while wall portion 42 extends upwardly and outwardly from the upper end of wall portion 40. Spring clip member 18 is of metal construction to permit the spring portion 38 to be deflected as will be described in more detail hereinafter.

Fascia member 20 comprises an outer wall portion 44 having a generally v-shaped portion 46 at its lower end which is adapted to receive the lower end portion 32 of spring clip member 18. As seen in FIG. 1, the upper end 48 of outer wall portion 44 is positioned above the upper end of spring clip member 18. Fascia member 20 includes an inclined wall portion 50 which extends downwardly and inwardly from the upper end of outer wall member 44. An inclined wall portion 52 extends downwardly, and at an angle thereto, from the lower end of inclined wall portion 50. The lower end of wall portion 52 is bent upon itself at 56 to provide a smooth lower end portion which will engage the roof membrane 12 in a secure fashion without cutting or tearing the roof membrane.

In use, the cant membrane 16 is secured to the roof in conventional fashion. The spring clip member is then secured to the cant member 16 as previously described. The roof membrane is then installed on the roof so that the edge of the roof membrane extends upwardly over cant member 16, wall portion 42 of spring clip 38 and thence downwardly adjacent the outer surface of outer wall member 30 of spring clip member 18. The fascia member 20 is then positioned above the spring clip member and moved downwardly relative thereto until the v-shaped portion 46 receives the lower end portion 32 of spring clip member 18. As the fascia member 20 is moved downwardly into position, the underside of inclined wall portion 50 engages and presses the roof membrane 12 between it and wall portion 42 of spring 38. The lower end portion of wall 52 engages and presses the roof membrane into engagement with the cant membrane 16 as illustrated in FIG. 1.

With the assembly in the position as illustrated in FIG. 1, the spring 38 is deflected downwardly and exerts yieldable force upwardly against the membrane and the fascia member to positively maintain the lower end portion 32 in the v-shaped portion 46 of fascia member 20. It can be seen from FIG. 1 that the roof membrane is actually held in place at three points. The first point of connection is between the lower end of wall portion 52 and cant member 16. The second place of engagement is between wall portion 42 and wall portion 50. The third point of attachment of the membrane is between the inner surface of outer wall member 44 and the outer portion of outer wall member 30.

Thus it can be seen that not only has a watertight connection been provided for the termination of the roof membrane but it can also be seen that the roof membrane is yieldably pressed or held in place at a plurality of engagement points so that the roof membrane will not be torn therefrom. It can therefore be seen that the invention accomplishes at least all of its stated objectives.

It is also extremely important to note that the system of this invention completely eliminates any penetration of fasteners through the roof membrane at the flashing area. The edge of the roof membrane is held in position in a secure manner without any nails or the like passing therethrough which could cause problems.

It should also be noted that a suitable vise plate, backup or underplate would be provided between the butt joints of members 20. In other words, if the members 20 are provided in lengths which are less than the length of the roof, a splice plate would be positioned beneath the butt joints thereof to permit passage of water therethrough.

It can therefore be seen that the invention accomplishes at least all of its stated objectives.

I claim:

1. A press lock fascia-cant system for installation on a building roof adjacent a wall, comprising, a cant member secured to the roof adjacent the wall and having a right triangle section, said cant member including a flat bottom portion mounted on the roof and having inner and outer edges, said outer edge positioned in substantially the same plane as the wall, an outer wall portion extending upwardly from said outer edge, and an inclined wall portion extending downwardly and inwardly to the inner edge of said bottom portion, a spring clip member secured to said cant member and comprising an outer wall member positioned outwardly of the outer wall portion of said cant member and having an upper end positioned at the upper end of said outer wall portion of said cant member, an inclined wall member extending downwardly from the upper end of said outer wall member over the upper end of said inclined wall portion of said cant member and terminating above the inner end of said bottom portion of said cant member, a spring portion extending upwardly from the lower end of said inclined wall member of said spring clip member and having an upper end portion which extends upwardly and outwardly from the upper end of said spring portion, said outer wall member of said spring clip member having a lower end portion which is positioned below the bottom portion of said cant member and which extends downwardly and outwardly with respect to said cant member, a fascia member detachably mounted on said spring clip member for maintaining a roof membrane therebetween, said fascia member comprising an outer wall portion positioned adjacent the outer wall member of said spring clip member to maintain the roof membrane therebetween, said outer wall portion of said fascia member having a substantially V-shaped lower end portion which receives the lower end portion of said outer wall member of said spring clip member, said outwardly portion of said fascia member having an upper end which is positioned above the upper end of the outer wall member of said spring clip member, said fascia member having a first inclined wall portion which extends downwardly and inwardly from the upper end of its said outer wall member over said spring portion whereby the roof membrane will be maintained therebetween, said fascia member having a second inclined wall portion which extends downwardly from the lower end of the first inclined wall portion for pressing the roof membrane into engagement with the cant member.

* * * * *